United States Patent [19]

Albert

[11] 4,025,741

[45] May 24, 1977

[54] INSERT DISPOSED IN STAND-OFF INSULATOR AND CIRCUIT INTERRUPTER INCLUDING SAME

[75] Inventor: Willard S. Albert, Trafford, Pa.

[73] Assignee: Westinghouse Electric Corporation, Pittsburgh, Pa.

[22] Filed: May 14, 1975

[21] Appl. No.: 577,514

[52] U.S. Cl. ..... 200/48 R; 174/165; 174/171; 174/177; 174/196; 403/268

[51] Int. Cl.[2] ..... H01H 31/00; H01B 17/16

[58] Field of Search ..... 174/141 R, 149 B, 150, 174/158 R, 165, 166 S, 169, 171, 176, 177, 178, 179, 180, 194, 196; 200/48 R, 48 KB, 50 AA; 339/218 R; 403/265–268

[56] References Cited

UNITED STATES PATENTS

| | | | |
|---|---|---|---|
| 946,623 | 1/1910 | Varney | 174/169 |
| 955,065 | 4/1910 | Hardin | 174/169 |
| 1,958,435 | 5/1934 | Hawley | 174/177 X |
| 2,879,323 | 3/1959 | Nichols et al. | 174/177 |
| 2,967,903 | 1/1961 | Mageoch | 174/180 |
| 3,585,277 | 6/1971 | Lewis | 174/178 X |
| 3,925,599 | 12/1975 | Cleaveland | 174/171 X |

FOREIGN PATENTS OR APPLICATIONS

| | | | |
|---|---|---|---|
| 386,989 | 4/1908 | France | 174/169 |
| A36,980 | 5/1930 | France | 174/171 |
| 1,032,117 | 3/1953 | France | 174/177 |
| 284,909 | 12/1952 | Switzerland | 174/177 |
| 106,640 | 9/1924 | Switzerland | 339/218 R |

*Primary Examiner*—Laramie E. Askin

*Attorney, Agent, or Firm*—M. J. Moran

[57] ABSTRACT

A cylindrical porcelain insulator having a depressed opening in at least one end thereof is utilized as a support member. An elongated steel stud having a threaded end and an enlarged securing end is disposed in the depressed central opening of the porcelain insulator. The enlarged securing end has circumferential lateral ridges and depressions for providing an enlarged surface area. Babbit or epoxy material is disposed in the remaining volume of the depressed opening. The securing end of the stud is therefore suspended in the hardened babbit or epoxy material, which in turn is affixed to the sides of the depressed opening, thus affixing the stud to the insulator. The stud has a relatively flat circumferential lateral shoulder at the upper end thereof which protrudes above the end of the insulator and out of the depressed opening. An electrical bus bar or bus bar retaining apparatus is disposed around the threaded portion of the stud to rest on the flat shoulder in a flat surface to flat surface relationship. Fastening means, such as a nut, is threaded onto the stud and torqued against the bus bar or bus bar retaining apparatus. The torquing stress provided to the bus bar is directed against the flat shoulder rather than the babbit material. When the bus bar or bus bar assembly has been thus secured to the stud with a predetermined amount of torque, the bus bar assembly will remain reliably affixed in place at that value of torque over a relatively long period of time and even when exposed to significant variations of temperature.

24 Claims, 6 Drawing Figures

INSERT DISPOSED IN STAND-OFF INSULATOR AND CIRCUIT INTERRUPTER INCLUDING SAME

BACKGROUND OF THE INVENTION

1. Field of the Invention

The invention relates generally to stand-off insulators. The invention relates specifically to porcelain stand-off insulators having depressions therein where stud means are secured to the porcelain body of the insulator with an intermediate babbit or similar material.

2. Description of the Prior Art

It is known to dispose stud members in openings in insulating members by utilizing an intermediate flowable material which subsequently hardens. Examples of this are found in the following U.S. Pat. Nos. 3,054,851, issued Sept. 18, 1962 to F. C. Foxe et al, entitled "Electrical Suspension Insulator With Improved Pin;" 1,594,207, issued July 27, 1962, to W. D. Kyle, entitled "Insulator;" and 1,022,993, issued Apr. 9, 1912 to G. W. Willis, also entitled "Insulator." It is also known to dispose a stud or pin in an insulator where the head of the pin or stud member is enlarged for the purpose of securing the pin or stud member to the insulator. Examples of this can be found in the following U.S. Pat. Nos.: 2,304,204, issued Dec. 8, 1942, to B. B. Ratzman, entitled "Electrical Insulator;" 1,735,982, issued Nov. 19, 1929, to C. R. Short, entitled "Resilient Connector;" 774,001, issued Nov. 1, 1904 to L. Steinberger, entitled "Track Structure"; 936,370, issued Oct. 12, 1909, to F. L. Sessions, entitled "Hanger For Wires"; 1,793,430, issued Feb. 17, 1931, to W. S, Mayer, entitled, "Bus Support"; 3,402,218, issued Oct. 1, 1968, to P. B. Thompson, entitled, "Weldable High Voltage Terminal"; 1,794,780, issued Mar. 3, 1931, to A. H. Leipert, entitled, "Spring Suspension"; and 2,279,170, issued Apr. 7, 1942 to S. B. Kraut, entitled, "Insulated Support For Lighting Units." It is also known to utilize female studs having wide shoulder portions in insulators such as is shown in U.S. Pat. No. 876,828, issued Jan. 14, 1908 to B. C. McNutt, entitled, "Insulator." Finally, it is also known to provide a stud or support member for utilization in conjunction with a cooperating insulator where the support member is free to move within the insulator, such as is disclosed in U.S. Pat. No. 2,396,131, issued Mar. 5, 1946 to W. M. Scott, Jr., entitled, "Bus Bar Support." All of the above U.S. patents present certain problems which render them less useful in many applications than the present invention. As an example, those members which utilize a widened head portion for the stud often require intricate assembly technique and in many instances introduce strain against the insulator member which may cause the member to break under certain conditions of utilization. Those members which utilize a stud and insulator in conjunction with an intermediate cement-like material either are not adapted in many cases to have a threaded end or when a threaded end is provided, the torquing of a fastening means on that threaded end may cause the stud to pull away from the cement-like material. In some circumstances the fastening or torquing operation may appear at first to be successful only to later deteriorate because of mechanical or physical relaxation or yielding of the intermediate cement-like material. This is especially true over long periods of time or when the insulator is exposed to significant variations in temperature. Those members which utilize the female insert require a matching bolt for securing purposes. In many applications, the utilization of a bolt is not desired or even possible because of space limitations. It would be advantageous if an insulator assembly could be provided having a stud means thereon for fastening purposes where the stud means could be utilized in conjunction with a separate fastening means such as a correspondingly threaded nut for securing and/or supporting electrical apparatus such as a bus bar or a bus bar supporting assembly. It would be advantageous if the bus bar and/or bus bar assembly could be disposed in place on the insulator in such a manner that a specific torque could be applied and then maintained over a relatively long period of time and over a relatively wide range of temperature variation. It is often necessary to maintain a predetermined value of torque in a fastening apparatus or assembly within reasonable limits. If, as an example, the applied torque is too large, insulator fracturing or radial shearing of the head from the intermediate cement-like material may occur. On the other hand, if the applied torque is too small, vibration and electrical forces may tend to cause the bus bar or bus bar assembly to loosen over a period of time. This is especially true where parallel bus bars or current carrying conductors are exposed to electrical conditions which cause magnetic interaction among the bus bars, which in turn cause forces to be applied at the point where a bus bar assembly is joined to an insulator.

SUMMARY OF THE INVENTION

In accordance with the invention, an apparatus is provided for securing one member to another. A support base is provided which has an opening therein. There is also provided a generally nonrelaxing stud means which may comprise an anchor portion, an engaging portion for engaging a corresponding force providing means and a shoulder portion which is disposed between the force providing means and the anchoring portion. Anchoring material is disposed in the opening in the support base and around the anchoring portion of the nonrelaxing stud means. This generally affixes the stud means to the support base. The anchoring material generally has a relatively greater tendency to yield under mechanical stress than the stud means which is relatively nonrelaxing or nonyielding. A force providing means is provided for cooperation with the engaging portion of the stud to force the member against the shoulder portion to thus secure the member to the support base by way of the stud means. Mechanical force provided by the force providing means is exerted primarily against the shoulder portion of the stud means rather than against the interface surface between the anchoring portion of the stud means and the anchoring material. This reduces the tendency of the anchoring material to mechanically yield at the interface region. Mechanical yielding may cause immediate catastrophic failure or may cause gradual relaxation of a predetermined value of applied torque. It is envisioned that the anchoring material will comprise material which may be introduced into the opening in a fluid state and then subsequently solidified in place. Typical examples of this kind of material are babbit and epoxy resins. The nonyielding stud means preferably comprises steel material and the force providing means preferably comprises a nut with an internally threaded portion that corresponds to the correspondingly threaded engaging portion. In a preferred embodiment of the invention, the support base comprises an electrical insulator such as porcelain. In a preferred embodiment of the invention, the electrical insulator is double-ended, that is, there is a stud means on either end of the support base. The shoulder portion generally comprises, in a preferred embodiment of the invention, a flat surface which is perpendicular to the axis of the elongated stud means and which provides a region against which a bus bar or similar means may abut and be supported. In a preferred embodiment of the invention, this flat surface extends above the end of the insulator so that generally all or most stress is introduced directly against the flat surface and none or little is introduced against the insulator. This tends to prevent the insulator from cracking. In a preferred embodiment, the babbit material or epoxy material has a raised upper surface which is made to correspond to or be level with the previously described shoulder portion. This provides an even wider base for support of the member to be supported by the insulator. In a preferred embodiment, the insulator is utilized with circuit breaker apparatus which may in turn be utilized in metal clad switch-gear equipment.

BRIEF DESCRIPTION OF THE DRAWINGS

For a better understanding of the invention, reference may be had to the preferred embodiments exemplary of the invention shown in the accompanying drawing in which.

DESCRIPTION OF THE PREFERRED EMBODIMENTS

Figure 1:
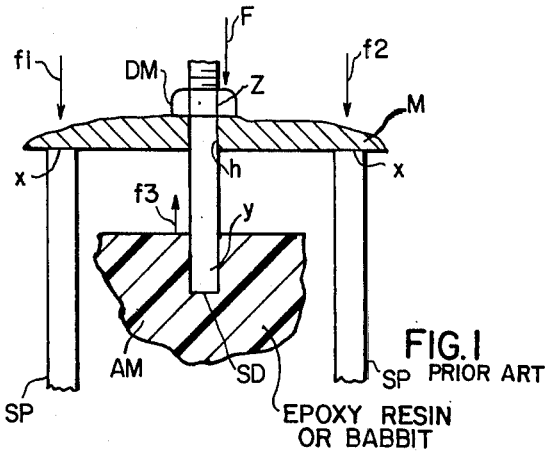
FIG.1 PRIOR ART
FIG. 1 shows a prior art fastening arrangement.

Referring now to the drawings, the inventive concepts of this invention are shown.

FIG. 1 shows a prior art fastening means and is shown and described here to provide an easily understandable basis for showing the inventive concepts of the present invention. In FIG. 1, two support means SP are vertically disposed and horizontally separated. A member M is horizontally disposed on the upper ends $x$ of the two support members SP. There is provided a stud member SD which is conveniently anchored in an anchoring material AM. In this case the anchoring material AM is shown as epoxy resin or babbit for the purpose of illustration. The surface area $y$ of the stud member SD provides a bonding interface region between the stud member SD and the anchoring material AM. The stronger the adhesive force between the stud member SD and the anchoring material AM at the region $y$ the more securely the stud SD is anchored. The stud SD conveniently protrudes through a hole $h$ in the member M and upward to the other side of the member M. A fastening means DM is provided in attached relationship to the upper end of the stud SD at the region Z. This member DM may be engaged in a threaded relationship with the upper end of the stud SD. The member DM is capable of providing a downward force F against the upper side of the member M thus forcing the member M against the two vertical pillars or supports SP at the regions $x$ as indicated by the resultant forces $f1$ and $f2$. The reason for providing the force F is to securely affix the member M in place against the support stanchions or pillars SP at the region $x$. However, it will be noted that the force F may, under certain circumstances, cause a smaller force $f3$ to be exerted by the stud SD against the anchoring material AM at the interface region $y$. This may have either or both of two effects. The first effect may be a catastrophic one. That is, under the infuence of force F the stud SD may pull away from the anchoring material AM at the region $y$ or portions of the anchoring material AM which remain attached or bonded to the stud SD may pull away from other portions of the anchoring material AM. This would happen if the force $f3$ overcomes the binding force equally distributed over the area $y$. The other effect, though less catastrophic, may be especially insidious under certain conditions. This effect is one of physical relaxation or yield of the anchoring material AM. If the anchoring material AM is of a certain type such as babbit, epoxy cement or the like, the force $f3$ may not cause an immediate rupture in the binding or interface region $y$ between the stud SD and the anchoring material AM or between portions of the anchoring material AM. Rather, the anchoring material AM may have the property of relaxing after some delayed increment of time from the application of the securing force F. Sometimes, this relaxation is known as time delayed yielding under stress. The yielding may also be a function of temperature. It is generally known that some things which are heated have a tendency to soften or loosen. This concept can be especially important when the member M is an electrical bus bar and the stanchions SP represent electrical insulators which are provided to securely hold the electrical bus bar M in place. In instances such as this, the driving means or forcing means DM is torqued or tightened onto the stud SD at region Z to a predetermined measured value of torque. It is often desirous that the torque be neither too large nor too small, as undesirable things happen in either case. As an example, if the torque is too small, the member M may not be securely fixedly attached to the support pieces SP. On the other hand, if the torque is too large, the support pieces may shatter or break even if the stud member SD was not pulled loose from the anchoring material AM. It is known that in many instances short circuit electrical currents or the like may flow in bus bars. It is not unusual to find bus bars disposed in a side-by-side position where electromagnetic effects may have a tendency to force the bars apart, especially under short circuit conditions or the like. In this case, if the fastening arrangement is not secure, vibrations and the like may occur which may enhance vibration and may even eventually cause breakage of the fastening arrangement, or in some circumstances, touching of adjacent bus bars causing catastrophic short circuit conditions, all of which are undesirable in the electrical insulating art. Close examination of FIG. 1 will show that some of the causes for the problems are related to the fact that the stress provided by the force F may be introduced into the interface region $y$ between the stud SD and the anchoring material AM as is exemplified by the force $f3$. If proper torquing or the like could be accomplished during the assembly operation without providing a way to introduce the force *f3*, then the problem of catastrophic separation of the stud SD from the anchoring material AM or the problem of yield under stress with time or temperature at the region *y* may be averted or significantly reduced.

Figure 2:
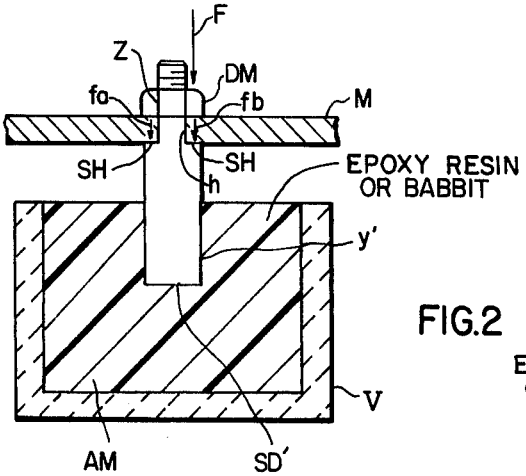
FIG. 2 shows a conceptual drawing of the present fastening apparatus.

Referring now to FIG. 2, a fastening apparatus for securely attaching member M to a stud SD′ is shown. One end of the stud SD′ is embedded in anchoring material AM along the surface *y′*. The anchoring material AM is contained in a support vessel V. In this case the anchoring material may comprise epoxy resin or babbit but is not limited thereto. It will be noted, however, that the relative lateral size of the stud SD′ is larger than the corresponding lateral size of the stud SD shown in FIG. 1. The upper end or top portion of the stud SD′ is generally the same size as the upper end or top portion of the stud SD shown in FIG. 1. This allows for the stud SD′ to be fed through the hole *h* in the member M and also allows for the driving means or forcing means DM to be inserted conveniently against or on the upper end of the stud SD′ at the region Z to allow the appropriate force F to be applied against the member M. However, the relative differences in the lower lateral size of the member SD′ and the upper lateral size of the member SD′ provides a shoulder region SH. It is against this shoulder region SH that the member M is disposed and it is against the shoulder region SH that the component forces *fa* and *fb* similar to forces *f1* and *f2* shown in FIG. 1 are applied. Such being the case, there is no corresponding force *f3*, as shown in FIG. 1, which is directable upward to pull the stud member SD′ away from the anchoring material AM at the interface region *y′* or to pull portions of anchoring material AM which remain attached to stud SD′ from other portions of anchoring material which remain attached to the support base. Consequently, once the proper torque (related to the force F) is applied to the driving means DM, there will be a significantly reduced tendency for that torque to change as a function of time or temperature. This is because stress at the anchoring materal AM interface region *y′* or elsewhere in the anchoring material AM is nonexistent or of a low order or magnitude.

Figure 3:
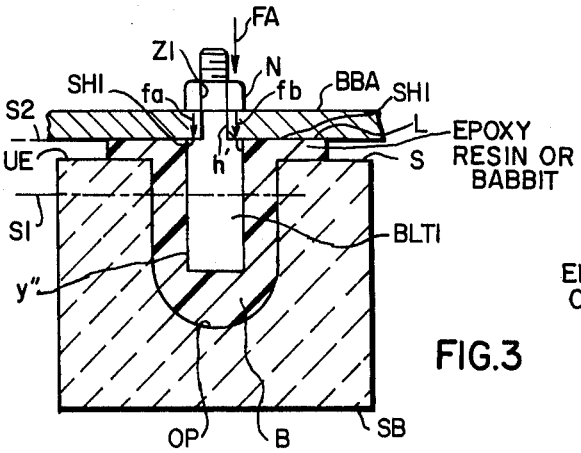
FIG. 3 shows another conceptual arrangment of the present fastening apparatus.

Referring now to FIG. 3, another embodiment of the invention is shown. In particular, there is provided a support base SB having therein a recessed opening OP. Disposed in the recessed opening OP is anchoring material B which may be, as an example, babbit or epoxy resin. Babbit is a material which is often used in the formation of certain kinds of bearings for utilization for heavy electrical equipment. Babbit is a soft silver-colored alloy of tin, copper and antimony. It is a kind of material that can be melted much in the way lead is melted and then disposed in a liquid molten state in the opening OP whereupon a bolt BLT1 may be disposed in the liquid babbit material B until the babbit material B hardens. When that happens, a relatively secure bond exists between the babbit and the bolt BLT1 and between the babbit and the surface of the support member SB defined by the opening OP. The bolt BLT1 of FIG. 3 is similar to the stud SD′ of FIG. 2 inasmuch as it has a shoulder SH1 similar to the shoulder SH of the stud SD′. Against the top surface of the shoulder SH1 is disposed a member which is to be held in place as part of the assembly of FIG. 3. This member is generally designated BBA. A fastening means which in this embodiment is a nut N is utilized with the upper portion of the bolt BLT1. The nut N engages the correspondingly threaded portion of the bolt BLT1 at the region Z1 and the force FA is applied against the top of the member BBA which in turn transmits resultant component forces *fa* and *fb* against the previously described shoulder SH1. In this embodiment of the invention, the upper surface L of the babbit, epoxy resin or anchoring material B may be disposed below the upper edge UE of the support base SB at S1 for example. The lower limit S1 for the upper surface L is related to the amount of surface area *y″* which exists at the interface between the babbit material B and the bottom portion of the bolt BLT1 which is sufficient to support the entire bolt BLT1 with the nut N and member BBA in fastened relationship. On the other hand, in a preferred embodiment, the upper surface L of the babbit material B extends out of the opening OP in the base SB and is laterally flush or level with the shoulder SH1 at S2. In this embodiment, the upper level S2 of the babbit material B also acts as a partial support for the member BBA. The top surface S2 of the babbit material B is not to be disposed above the shoulder SH1. Also, the shoulder SH1 is not to be disposed below the level of the top surface UE of the support base SB.

Figure 4:
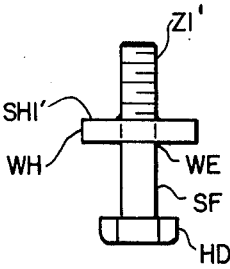
FIG. 4 shows a bolt and securely fixed washer arrangement which may be utilized as an alternative for a portion of the apparatus of FIG. 3.

Referring now to FIG. 4, there is shown another bolt member BLT2 which may be used in place of the bolt member BLT1 of FIG. 3. The bolt member BLT2 comprises a simple bolt having a shaft SF, an enlarged head HD, and a threaded section Z1′. Intermediate to or between the threaded section Z1′ and the head HD is disposed a properly fitting washer WH which is welded or otherwise fixedly secured to the shaft SF at the weld points WE to thus create a bolt having a large shoulder SH1′ which may generally correspond to the shoulder SH1 of the bolt BLT1 of FIG. 3.

Figure 5:
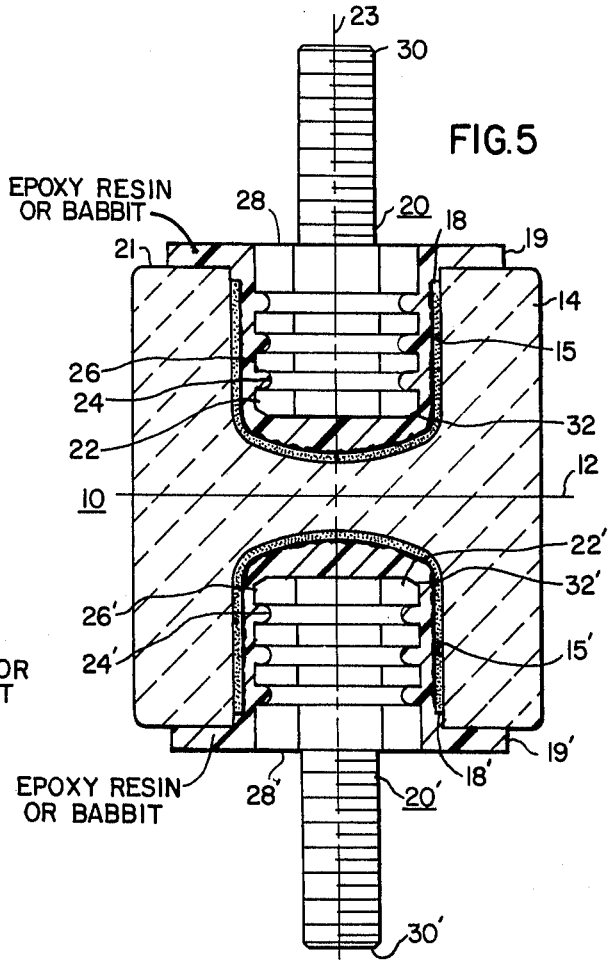
FIG. 5 shows an insulator with studs on either end thereof which utilizes the present inventive concept.

Referring now to FIG. 5, another embodiment of the invention is shown. This invention comprises a porcelain insulator 10. Porcelain insulator 10 is generally vertically symmetrical about the line 12. Portions of the insulator assembly above the line 12 are identified with given reference numerals and corresponding portions below the line 12 are identified with corresponding reference numerals having a prime symbol (′) associated therewith. The insulator 10 comprises a porcelain or similar base 14 which is suitable for support and insulation purposes in an electrically conducting system such as the kind which may include relatively large, heavy bus bar which may conduct large currents at low or high voltages and during short circuit conditions. There is provided a recessed opening 15 that has fused to the surface thereof granular material such as sand 18. There is disposed in this opening 15 babbit or epoxy resin material 32. The babbit material, as was the case with respect to the apparatus of FIG. 3, extends outwardly from the opening onto the top surface 21 of the insulating support base 14. The extended babbit material M is shown at 19. There is provided a stud member 20 having a lower portion 22 which is significantly larger in radial dimension than the upper portion 30. The lower portion in addition has alternating valleys 24 and ridges 26, respectively, which provide for a significant increase in the external surface area of the lower bolt portion 22. The babbit material 32 which may not wet or directly adhere to the porcelain innersurface of the opening 15 of the support member 14 is nevertheless held in place by the numerous various protrusions in the sandy material 18 which act as locks or anchors for the babbit material, thus preventing it from moving circumferentially about the axis 23 or longitudinally in the direction of the axis 23. In addition, the combination of ridges and valleys 26 and 24 also provides enhanced interlocking between the babbit material 32 and the bottom portion 22 of the bolt member 20 to prevent longitudinal pull-out. To prevent bolt rotation, the portion 22 may be made hexagonally shaped. The upper surface 28 of the bottom portion 22 of the bolt member 20 comprises a shoulder upon which a member such as a bus bar supporting structure may rest, similar to the shoulder SH1 shown in FIG. 3. The shoulder 28 may be at the level of the top portion of the babbit as indicated at 19. The upper portion 30 may protrude through an opening in a member (not shown) which rests upon the shoulder 28. A threadable nut member (also not shown) may be threaded upon the top portion 30 of the bolt member 20, thus exerting pressure against the member to be secured against the top shoulder 28. The restraints as to the limits of the relative disposition of the level or top surface of the shoulder 28, the top portion or surface 21 of the insulator 14 and the uppermost portion or surfce 21 of the babbit material 32 are generally similar to those described with respect to the embodiment of FIG. 3. Since the portion of the insulator 14 below the symmetrical centerline 12 and the cooperation between the various parts of the fastening apparatus 10 below the centerline 12 are generally unchanged with respect to the upper portion, that is the portion above the centerline 12, the discussion of the operation concerned therewith is generally redundant and is therefore not provided for the purpose of simplicity of description and operation. The insulating member 10 may be utilized in both the vertical disposition such as shown in FIG. 5 or in a horizontal disposition or in other angular disposition intermediate to the horizontal and vertical disposition. The general disposition is relatively nonlimiting provided the support function and the insulating function of the member 10 are not defeated.

Figure 6:
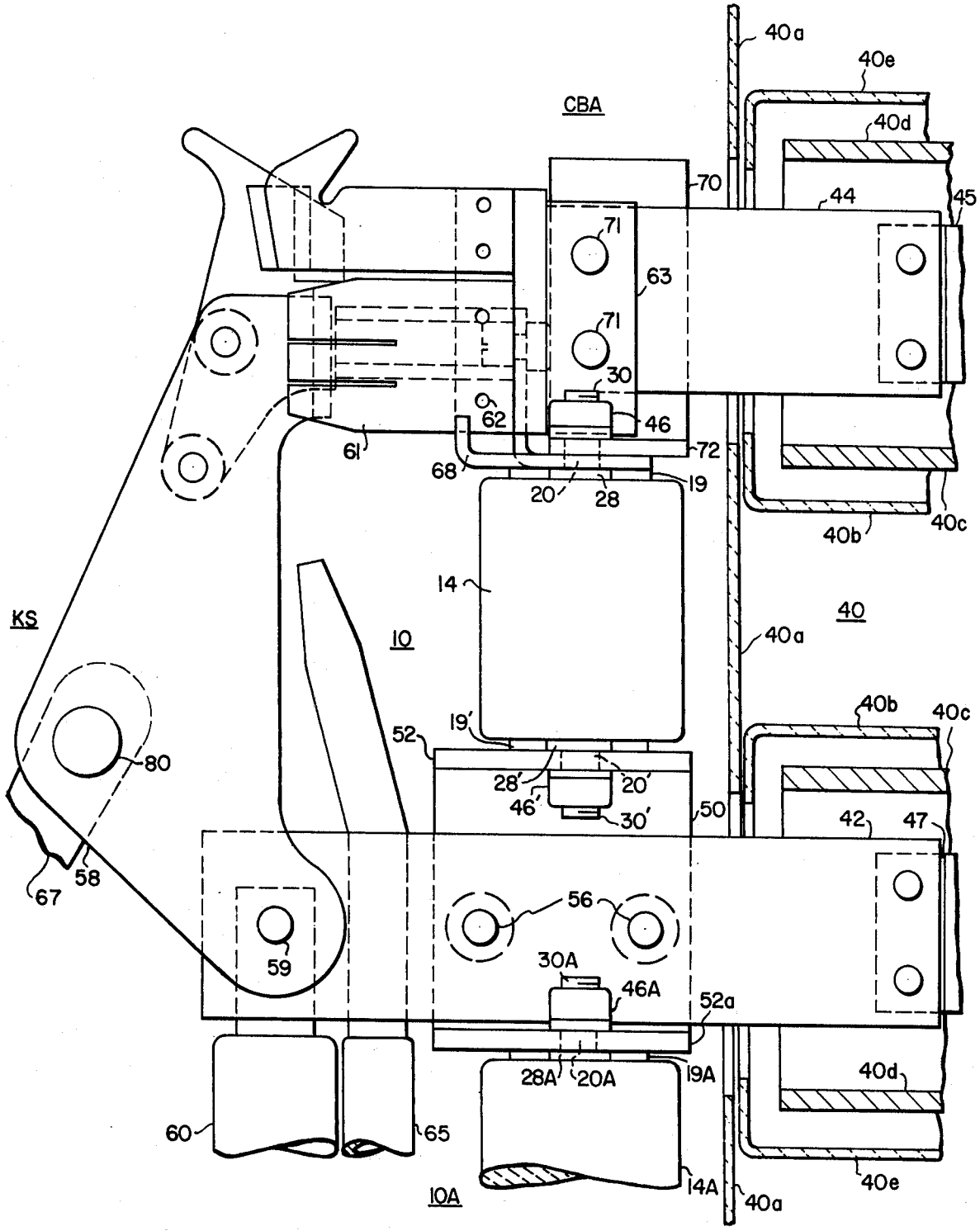
FIG. 6 shows electrical circuit interrupting apparatus utilizing the inventive concept of FIG. 5.

Referring now to FIG. 6, there is shown an embodiment utilizing the insulating member 10 in circuit breaker or circuit interrupter apparatus which is generally designated CBA. In this nonlimiting application, the circuit breaker comprises a knife switch or blade member generally designated KS. There is also provided to the right in FIG. 6, a metal clad switchgear equipment enclosure generally designated 40. It is to be understood that the application of the insulator 10 is much broader than the narrow application shown in FIG. 6. FIG. 6 is utilized to show an embodiment of the invention and an example for its use. In this embodiment of the invention, there are shown various cross-sections of the metal clad cell components for switchgear which are generally designated 40*a* through 40*e*. From the bottom of the circuit breaker, there is provided a relatively heavy bus bar 42 which extends outwardly to the right and toward the metal clad switchgear cabinet 40. Likewise to the top, there also exists a relatively large and heavy bus bar 44 which extends outwardly and to the right and toward the upper portion of the metal clad switchgear cabinet 40. The bus bars 44 and 42 are part of the circuit breaker. There is provided an assembly member 70 which has a lower lip 72 which cooperates with a member 68 in such a manner that both the members are supported by the shoulder 28 and a portion of the babbit 19 which extends above the porcelain case 14 of insulator 10. The shaft 20 protrudes through the members 72 and 68 to form a threaded portion 30 at the upper end thereof. A nut or similar means 46 is turned down upon the threaded portion 30 to provide compression against the members 72 and 68, against the shoulder 28 and to a lesser extent against the babbit material 19. A proper torque is applied to the nut 46 to secure the members 72 and 68 to the shoulder portion 28. Against the vertical extension of the assembly member 70 is provided the relatively heavy conductor 44 (part of circuit breaker). A bolt or bolts, such as indicated at 71, may be utilized to hold the members 44, 63 and 70 in relatively fixed, tight relationship. Applied to the end of the member 63 is a jaw member 61. Jaw member 61 is held to member 63 by fastening pieces 62. In a like manner, the bus bar 42 is fastened at and supported by bolt members 56 against a channel member 50. The channel member 50 extends vertically in a flat side-by-side relationship with the bus bar 42. The channel member 50 has an upper lateral flange 52 and a lower lateral flange 52*a*. The upper lateral flange 52 is disposed against the surface of the shoulder 28' of the lower stud member 20' of the insulator 10. The babbit portion 19' is also shown. The threaded fastening portion 30' extends through the flange 52. The fastening means or nut 46' is turned on the threaded portion 30' to securely attach the flange member 52 to the shoulder 28' and thus to the insulating support member 10. In a like manner, there is also provided at the lower portion of FIG. 6, a second insulator 10A which comprises a base of porcelain insulating material 14A. Likewise, there is provided a shoulder 28A for a stud member or bolt 20A. The stud member 20A extends through the lower flange portion 52*a* of the bus bar assembly or support member 50. The upper portion or the thinner portion of the stud member 20A has a threaded portion 30A thereon upon which is threaded the fastening means or nut 46A similar to the way fastening means 46' and fastening means 46 are disposed upon the threaded members 30' and 30, respectively. All three members 46, 46' and 46A may be attached to their respective threaded members 30, 30' and 30A, respectively, with a predetermined torque such as may be applied with a torque wrench during assembly. This may be done so that the flange portions 72, 52 and 52a, respectively, are held against the shoulders 28, 28' and 28A, respectively, of the stud members 20, 20' and 20A, respectively. It will be noted that the bottom portion of the insulating support member 10 cooperates with the top portion of the insulating support member 10A to support between them the channel member 50 and thus the bus bar 42. There is provided at the outer end of the bus bar 42 a pivotable knife blade 58 which is pivotable about a bolt or pivoting means 59. A support member 60 is utilized for support of the end of the span of the bus bar member 42 below the point of the pivot 59 and for providing a hinge for blade 58. A driving member 67 may be connected to a similar pivot member 80 which is radially disposed from the pivot member 59 such that the driving member may cause the switchblade 58 to rotate through an arc about the pivot member 59, thus moving the upper portion of the knife blade 58 into and out of contact, as may be desied, with the jaw portion 61 of the upper portion of the circuit breaker assembly CBA. The means for causing movement of the driving member may be pneumatic, mechanical or manual. The knife switch assembly KS may be of the load break or no load break type or may be of the disconnect type. The assembly of FIG. 6 may be utilized to interrupt overload or short circuit current. A gas supply means 65 is provided for introducing gas or air into the region of the jaw 61 during an opening operation.

It is to be understood with respect to the embodiment of the invention that the insulator materal generally designated 14 may be any suitable kind of an insulating material. It is also to be understood that the embodiment of FIG. 6 is not limiting in that the metal clad switchgear such as indicated at 40 or the exact configuration of the knife switch such as indicated at KS is not limiting or necessary in all cases. It is to be understood that the configuration of multiple insulators may be a stack such as shown by the combination of 10 and 10A in FIG. 6. The insulators may be used singularly, that is they may be used as single conductor support pieces, that is, the insulator need not support two electrical conductors one at each end thereof, such as shown at 10. Alternately, they may support merely one electrical conductor, such as at either end thereof. It is also to be understood that the electrical conductive material may be copper or the like. It is also to be understood that the support members 10 and 10A need not necessarily directly support the bus bars or electrical conductors but may support assemblies which may support electrical conductors. Such an assembly is shown at 50 and another is shown at 70 in FIG. 6. It is also to be understood that the force providing means such as 46', 46A, 46 or FIG. 6, DM of FIG. 2 and N of FIG. 3 may be a simple nut with an internal thread. It is to be understood that the circuit breaker apparatus such as exemplified at KS at FIG. 6 may be disposed within metal clad switchgear or casing means such as shown at 40 of FIG. 6. It is understood that this invention applies to, but is not limited to, apparatus for securing a member to an electrical insulator assembly for supporting an object or to an electrical insulator for utilization with a circuit breaker or the like. It is also to be understood that the shoulder portions such as shown at SH in FIG. 2, SH1 in FIG. 3 or 28 and 28', for example, of FIGS. 5 and 6 may be variously described as being between or intermediate the ends of a stud member or a bolt. It is to be understood that the upper portion of the bolt member or the stud member such as 30 in FIG. 5, or Z in FIG. 2 or Z1 in FIG. 3 may be called an engaging portion. It is also to be understood that the stud member may comprise a nonrelaxing stud means which is externally threaded at one end thereof, which is steel in some embodiments of the invention and which is elongated in some embodiments of the invention. It is to be understood that the various support bases or support members called for herein may be generally cylindrical porcelain insulating support bases or members. It is to be understood that the portion generally designated 22 or 22' in FIG. 5 may be known as anchoring portion having ridges and valleys at 26 and 24, for example. Likewise, the lower portions of the stud means SD' in FIG. 2 and the bolt means BLT1 of FIG. 3 may be known as anchoring portions. It is also to be understood that the anchoring material such as identified as AM in FIG. 2 or B in FIG. 3 or 32 and 32' in FIG. 5 may comprise babbit or epoxy resin material or the like and may comprise material which is generally defined as presently solidified but originally fluid. It is also to be understood that the presence of sand or granular material called for with respect to reference numeral 18 is not necessary for structural and functional cooperation in the invention, but is provided as a practical means for joining babbit material and porcelain material. Other substitutes may be utilized in appropriate circumstances. It is to be understood that with respect to all embodiments of the invention the yield characteristic of the anchoring material may be such that in the absence of the present inventive concepts stress may lead to yielding in the system due to stress at the interface region or in the anchoring material.

The apparatus taught in this invention have many advantages. One advantage lies in the fact that an insulating support member may be utilized which has generally fastenable male means thereon and where a member may be attached to the support member with a nut or similar relatively small fastening means. As an example, with respect to FIG. 6, since the members 20, 20' and 20A are male members, only small nut members 46, 46' and 46A, respectively, need be applied to the portions 30, 30' and 30A, respectively. If the fastening means for the insulators 10 and 10A were female, then relatively large bolts having elongated portions would have to be joined to the support member threadably or otherwise within the constraints of the channel portions 50 and 70, for example, Another advantage lies in the fact that the support members may be utilized to support and fasten bus bar or bus bar assembly apparatus. The fastening operation may be done to a specified torque or force where it is required or envisioned that there will be no significant change in torque or relaxation of the holding pressure or force after an increment of time has passed (within limits) and after a variation of temperature has taken place at the insulator (within limits). Another advantage lies in the fact that the shoulder member not only supports that portion which is disposed against it, but is utilized in conjunction with the other portions of the bolts in the fastening means to generally restrain all the mechanical forces which may occur during an assembly operation and thereafter transfer force to the bolt or stud member rather to the surrounding material in which the stud member is embedded.

What I claim as my invention is:

1. Apparatus for securing a generally flat rigid member comprising:

a. a support base having a surface region with a recess therein;

b. generally non-relaxing stud means disposed in said recess, comprising:

1. an anchoring portion;
2. an engaging portion for engaging a force-providing means; and
3. a shoulder portion disposed between said engaging portion and said anchoring portion, said shoulder portion having a generally flat shoulder surface on the engaging portion side thereof;

c. anchoring material disposed in said recess and around said anchoring portion to a point on said stud means which is generally flush with said shoulder surface for generally affixing said stud means to said support base, said anchoring material having a relatively greater tendency to yield under mechanical stress than said stud means, said flat shoulder surface being disposed out of said recess beyond the level of said surface region of said support base; and d. force-providing means disposed on said engaging portion for utilization in cooperation with said engaging portion to apply force against said generally flat rigid member to thereby generally fixedly secure said latter member to said stud means between said force-providing means and the combination of said flat shoulder surface and said flush anchoring material, mechanical stress caused by said force being thus directed generally against said shoulder surface of said non-relaxing stud means rather than said support base directly thus reducing the tendency of said anchoring material to physically yield under said force.

2. The combination of claimed in claim 1 wherein said anchoring material comprises presently solidified originally fluid material.

3. The combination as claimed in claim 1 wherein said anchoring material comprises babbit.

4. The combination as claimed in claim 1 wherein said anchoring material comprises epoxy resin.

5. The combination as claimed in claim 1 wherein said stud means comprises steel.

6. The combination as claimed in claim 1 wherein said force-providing means comprises a nut with an internally threaded portion, said engaging portion comprises a corresponding externally threaded member engaged with said nut to thus cooperate to provide force for securing said member.

7. An electrical insulator assembly for securing a generally flat rigid electrical conductor to an object, comprising:

a. an insulating support base having a surface region with a recess therein, said support base being adapted to be disposed upon said object;

b. generally non-relaxing stud means disposed in said recess, comprising:

1. an anchoring portion;
2. an engaging portion for engaging a force-providing means; and
3. a shoulder portion disposed between said engaging portion and said anchoring portion, said shoulder portion having a generally flat shoulder surface on the engaging portion side thereof;

c. anchoring material disposed in said recess and around said anchoring portion to a point on said stud means which is generally flush with said shoulder surface for generally affixing said stud means to said insulating support base, aid anchoring material having a relatively greater tendency to yield under mechanical stress than said stud means, said flat shoulder surface being disposed out of said recess beyond the level of said surface region of said insulating support base; and d. force-providing means disposed on said engaging portion for utilization in cooperation with said engaging portion to apply force to said generally flat rigid conductor to thereby generally fixedly secure said conductor to said non-relaxing stud means between said force providing means and the combination of said flat shoulder surface and said flush anchoring material, mechanical stress caused by said force being thus directed generally against said shoulder surface of stud means rather than said support base directly thus reducing the tendency of said anchoring material to physically yield under said force.

8. The combination as claimed in claim 7 wherein said anchoring material comprises presently solidified originally fluid material.

9. The combination as claimed in claim 7 wherein said anchoring material comprises babbit.

10. The combination as claimed in claim 7 wherein said anchoring material comprises epoxy resin.

11. The combination as claimed in claim 7 wherein said stud means comprises steel.

12. The combination as claimed in claim 7 wherein said force-providing means comprises a nut with an internally threaded portion, said engaging portion comprises a corresponding externally threaded member engaged with said nut to thus cooperate to provide force for securing said conductor to said insulating supporting base and thus to said object.

13. Circuit interrupter apparatus, comprising:

a. separable main contact means;

b. operating means interconnected with said separable main contact means for causing said separable main contact means to open and close under predetermined conditions;

c. support means supporting said separable main contact means; and d. electrical insulator means for securing to said support means a generally flat rigid electrical conductor which is interconnected electrically with aid separable main contact means, comprising:

1. an insulating support base having a surface region with a recess therein, said support base being disposed upon said support means;
2. generally non-relaxing stud means disposed in said recess, comprising:
   i. an anchoring portion;
   ii. an engaging portion for engaging a force-providing means; and
   iii. a shoulder portion disposed between said engaging portion and said anchoring portion, said shoulder portion having a generally flat shoulder surface on the engaging portion side thereof;
3. anchoring material disposed in said recess and around said anchoring portion to a point on said stud means which is generally flush with said shoulder surface for generally affixing said stud means to said insulating support base, said anchoring material having a relatively greater tendency to yield under mechanical stress than said stud means, said flat shoulder surface being disposed out of said recess beyond the level of said surface region of said support base; and
4. force-providing means disposed on said engaging portion for utilization in cooperation with said engaging portion to apply force against said generally flat rigid conductor to thereby generally fixedly secure said conductor to said stud between said force-providing means and the combination of said flat surface and said flush anchoring material, mechanical stress caused by said force being thus directed generally against said shoulder surface of said non-relaxing stud means rather than said support base directly thus reducing the tendency of said anchoring material to physically yield under said force.

14. The combination as claimed in claim 13 wherein said anchoring material comprises presently solidified originally fluid material.

15. The combination as claimed in claim 13 wherein said anchoring material comprises babbit.

16. The combination as claimed in claim 13 wherein said anchoring material comprises epoxy resin.

17. The combination as claimed in claim 13 wherein said stud means comprises steel.

18. The combination as claimed in claim 13 wherein said force-providing means comprises a nut with an internally threaded portion, said engaging portion comprises a corresponding externally threaded member engaged with said nut to thus cooperate to provide force for securing said conductor to said support means.

19. The combination as claimed in claim 13 wherein said electrical insulator means comprises porcelain.

20. The combination as claimed in claim 13 wherein said anchoring portion has ridges and valleys therein for enhanced anchoring in said anchoring material.

21. An electrical insulator assembly which secures a generally flat rigid electrical conductor assembly to a circuit interrupter, comprising:

a. a generally cylindrical porcelain support base having a surface region with a recess therein;

b. a generally non-mechanically relaxing elongated steel stud disposed in said recess, said stud having an anchoring portion with ridges and valleys therein at one end thereof, an externally threaded portion at the other end thereof, and an intermediate shoulder, said shoulder having a shoulder surface on the threaded portion side thereof;

c. babbit disposed in said recess and around said anchoring portion of said stud to a point on said stud which is generally flush with said shoulder surface to thereby affix said stud to said support base, said shoulder surface being disposed out of said recess beyond the level of said surface region of said porcelain support base; and d. a nut, said nut having an internal thread which corresponds to said externally threaded portion of said stud, said nut being disposed on said stud, said generaly flat rigid conductor assembly being held between said nut and the combination of said flat shoulder surface and said flush babbit with a generally fixed force regardless of the passage of time within limits and regardless of variation of temperature within linits because of the generally non-mechanically relaxing quality of said stud relative to said babbit.

22. An electrical insulator assembly which secures a generally flat rigid electrical conductor assembly to a circuit interrupter, comprising:

a. a generally cylindrical porcelain support base having a surface region with a recess therein;

b. a generally non-mechanically relaxing elongated steel stud disposed in said recess, said stud having an anchoring portion with ridges and valleys therein at one end thereof, an externally threaded portion at the other end thereof, and an intermediate shoulder, said shoulder having a shoulder surface on the threaded portion side thereof;

c. epoxy resin material disposed in said recess and around said anchoring portion of said steel stud to a point on said stud which is generally flush with said shoulder surface to thereby affix said stud to said support base, said shoulder surface being disposed out of said recess beyond the level of said surface region of said porcelain support base; and d. a nut, said nut having an internal thread which corresponds to said externally threaded portion of said stud, said nut being disposed on said stud, said generally flat rigid conductor assembly being held between said nut and the combination of said flat shoulder surface and said flush epoxy resin with a generally fixed force regardless of the passage of time within limits and regardless of the variation of temperature within limits because of the generally non-mechanical relaxing quality of said stud relative to said epoxy resin.

23. Circuit interrupter apparatus, comprising:

a. separable main contact means;

b. operating means interconnected with said separable main contact means for causing said separable main contact means to open and close under predetermined conditions;

c. support means supporting said separable main contact means; and d. electrical insulator means which secures a generally flat rigid electrical conductor assembly which is interconnected with said separable main contact means to said support means, comprising:

1. a generally cylindrical porcelain support base having a surface region with a recess therein;

2. a generally non-mechanically relaxing elongated steel stud disposed in said recess, said stud having an anchoring portion with ridges and valleys therein at one end thereof, an externally threaded portion at the other end thereof, and an intermediate shoulder, said shoulder having a shoulder surface on the threaded portion side thereof;

3. babbit disposed in said recess and around said anchoring portion of said steel stud to a point on said stud which is generally flush with said shoulder surface to thereby affix said stud to said support base, said shoulder surface being disposed out of said recess beyond the level of said surface region of said porcelain suppot base; and 4. a nut, said nut having an internal thread which corresponds to said externally threaded portion of said stud, said nut being disposed on said stud, said generally flat rigid conductor assembly being held between said nut and the combination of said flat shoulder surface and said flush babbit with a generally fixed force regardless of the passage of time within limits and regardless of the variation of temperature within limits because of the generally non-mechanically relaxing quality of said stud relative to said babbit.

24. Circuit interrupter apparatus, comprising:

a. separable main contact means;

b. operating means interconnected with said separable main contact means for causing said separable main contact means to open and close under predetermined conditions;

c. support means supporting said separable main contact means; and d. electrical insulator means which secures a generally flat rigid electrical conductor assembly which is interconnected with said separable main contact means to said support means, comprising:

1. a generaly cylindrical porcelain support base having a surface region with a recess therein;

2. a generally non-mechanically relaxing elongated steel stud disposed in said recess, said stud having an anchoring portion with ridges and valleys therein at one end thereof, an externally threaded portion at the other end thereof, and an intermediate shoulder, said shoulder having a shoulder surface on the threaded portion side thereof;

3. epoxy resin material disposed in said recess and around said anchoring portion of said steel stud to a point on said stud which is generally flush with said shoulder surface to thereby affix said stud to said support base, said shoulder surface being disposed out of said recess beyond the level of said surface region of said porcelain support base; and 4. a nut, said nut having an internal thread which corresponds to said externally threaded portion of said stud, said nut being disposed on said stud, said generally flat rigid conductor assembly being held between said nut and the combination of said flat shoulder surface and said flush epoxy resin with a generally fixed force regardless of the passage of time within limits and regardless of the variation of temperature within limits because of the generally non-mechanically relaxing quality of said stud relative to said epoxy resin.

* * * * *